United States Patent [19]

Gygi

[11] Patent Number: 4,541,574

[45] Date of Patent: Sep. 17, 1985

[54] MILLING PROCESS AND ROLLER MILL

[76] Inventor: Martin H. Gygi, Rheinstrasse 5, 7890 Waldshut, Fed. Rep. of Germany

[21] Appl. No.: 529,594

[22] Filed: Sep. 6, 1983

[30] Foreign Application Priority Data

Sep. 6, 1982 [CH] Switzerland ..... 5295/82

[51] Int. Cl.[4] ..... B02C 23/24

[52] U.S. Cl. ..... 241/57; 241/119; 241/124; 241/152 A; 241/160

[58] Field of Search ..... 241/19, 24, 29, 52, 241/57, 76, 79.1, 117-122, 124, 161, 267, 129-131, 152 A, 159, 152 R, 160

[56] References Cited

U.S. PATENT DOCUMENTS

| | | | |
|---|---|---|---|
| 136,721 | 3/1873 | Hanctin | 241/124 |
| 2,958,473 | 11/1960 | Massie | 241/124 X |
| 3,510,071 | 5/1970 | Whitney, Jr. | 241/61 |
| 3,763,772 | 10/1973 | Baker | 241/267 X |
| 4,385,730 | 5/1983 | Kartman | 241/119 |

FOREIGN PATENT DOCUMENTS

| | | |
|---|---|---|
| 406795 | 8/1966 | Switzerland . |
| 558678 | 2/1975 | Switzerland . |

*Primary Examiner*—Mark Rosenbaum
*Attorney, Agent, or Firm*—Ladas & Parry

[57] ABSTRACT

An improved milling process, wherein the material to be crushed is processed within a circular milling path under the action of at least one roller rolling along said path. The material is fed evenly distributed around the circumference of the milling path and enters it with a predetermined initial speed transversely to the extension of the path such that each piece to be crushed is subjected at least once to the action of one of the rollers. Under the action of an air current which is guided across the milling path pulverized material below a given grain size is immediately removed from the milling path, thereby avoiding the build-up of a thick and energy consuming layer on the milling path such that the milling forces are limited to the breaking forces for crushing the pieces fed into the milling path.

10 Claims, 6 Drawing Figures

MILLING PROCESS AND ROLLER MILL

BACKGROUND OF THE INVENTION

1. Field of the Invention

The present invention relates to an improved milling process and a roller mill. More specifically, this invention is directed to an improved milling process, wherein the material to be crushed is processed at a circular milling path under the action of at least one roller rotating along said path.

2. Description of the Prior Art

In conventional milling processes and roller mills of the above type the material to be crushed is fed through a peripheral opening situated above the milling path, as e.g. shown in the Swiss patent publications Nos. 558,678 and 406,795. It enters the milling chamber at one side, is partly seized by the rollers and partly falls down through the rollers, without having been contacted by one of them, into a collecting trough. From there the material is thrown upwards into the milling path by the action of rotating shovels, as can be seen from Swiss patent No. 406 795. An air current flowing through the mill chamber carries away the fine material. In mills of this type, as they also are shown in U.S. Pat. No. 1,499,516 and U.S. Pat. No. 3,955,766, the material to be crushed is thrown around in an uncontrolled way within the milling chamber. In addition to the newly fed material, already crushed pieces which still are in the milling chamber repeatedly are thrown into the milling path such that the milling rollers act upon a mixture of fine and coarse pieces which considerably reduces the efficiency of the milling process due to the necessary displacement of the fine material and the internal friction of the material under the influence of the rollers. The one-sided feeding of the material and the uncontrolled flow of the same within the milling chamber lead to extensive wear, especially of the stationary parts in the milling chamber.

In the U.S. Pat. No. 1,499,624 another mill of the mentioned type is disclosed, wherein said drawbacks are avoided by means of a violent air current which, outside the milling chamber, carries back both the crushed material and the pieces which had not been subjected to the action of the rollers to the inlet of the mill such that all pieces above a certain grain size are again introduced into the mill together with the new material. This mill, however, has the drawback, that the material fed enters the milling path in an uncontrolled way, which results in a poor efficiency, since it is necessary to feed back the material several times by means of said energy consuming air current until the desired grain size is achieved.

Finally, from U.S. Pat. No. 2,189,441 a mill is known, wherein the supply of the material to be crushed into the milling path of the rollers proceeds in a controlled manner. The material enters the milling path distributed over the whole circumference and is subjected there to the action of the rollers. However, no means are provided to carry the crushed particles out of the milling path, the influence of the adhesive forces on them normally being bigger than the gravitational forces. Therefore, in this mill a relatively thick material layer builds up on the milling path during operation due to reduced removal of the crushed material from this area. As a consequence uncontrolled material flow will be caused due to turbulences partly annulling the effect of controlled supply. Furthermore, the efficiency of the milling action will be reduced due to internal friction in the layer on the milling path.

SUMMARY OF THE INVENTION

Hence, it is an object of the present invention to provide an improved milling process and roller mill avoiding the above drawbacks and allowing completely controlled material to flow through the mill.

Another object of this invention aims at the provision of an improved milling process and roller mill, which are less energy consuming than the known devices.

Still another object of the invention is to avoid a material layer on the milling path for reducing the effects of internal friction of the material. The crushing process should be based merely on breaking the pieces between the rollers and the wall of the milling chamber.

Now in order to implement these and still further objects of the invention, which will become more readily apparent as the description proceeds, the improved process, wherein the material to be crushed is processed at a circular milling path under the action of at least one roller rotating along said path, comprises the steps of feeding the material to be crushed evenly distributed around the circumference of the milling path and providing it with a predetermined initial speed transversely to the extension of the path such that each piece to be crushed is subjected at least once to the action of one of the rollers and simultaneously generating a current of air across the milling path in order to carry crushed pieces below a certain size out of the milling path. The roller mill therefore comprises a distribution device for evenly distributing the centrally introduced material around the circumference of a circular milling path, at least one roller rotating along said milling path, means for adjusting the initial speed of the material entering the milling path, a fan for generating an air current and air guiding means for guiding the air current across the milling path. According to a further embodiment of the invention the rollers are contained in a rotating housing, having an outer wall which is substantially concentric to the milling path and having openings for the rollers such that a defined air gap is formed therebetween.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF PREFERRED EMBODIMENTS

Figure 1:
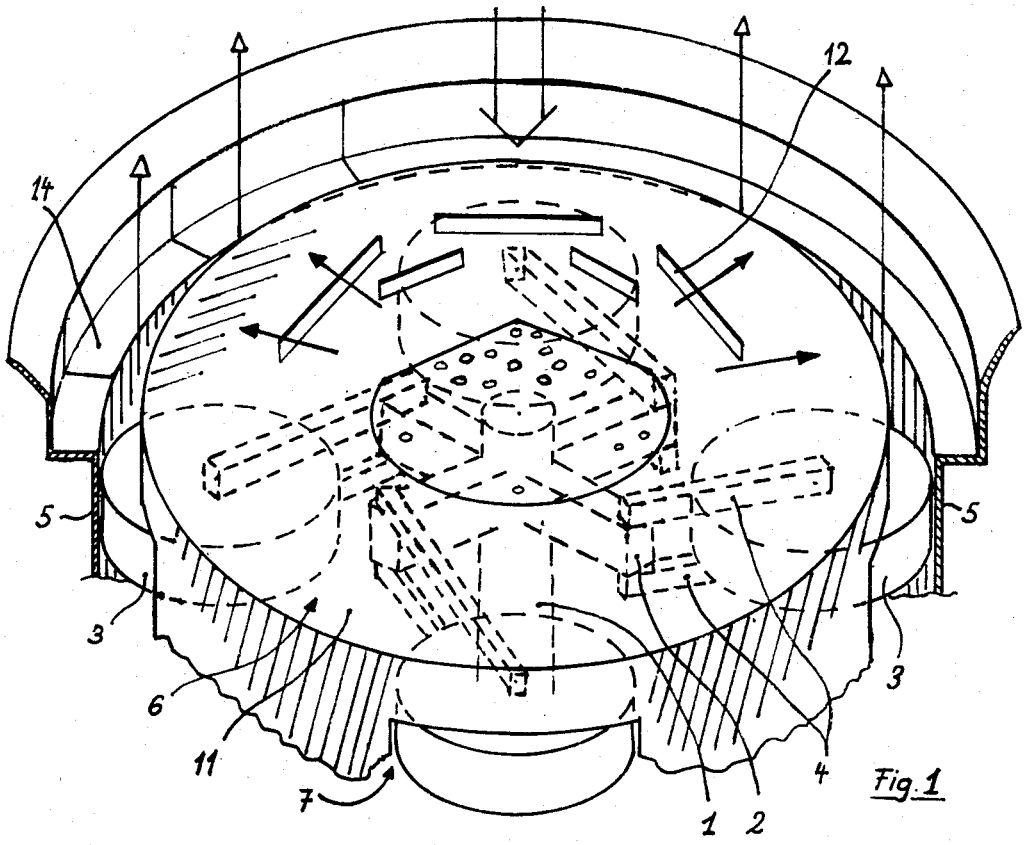
FIG. 1 schematically exhibits a roller mill according to the invention in perspective view.
Figure 2:
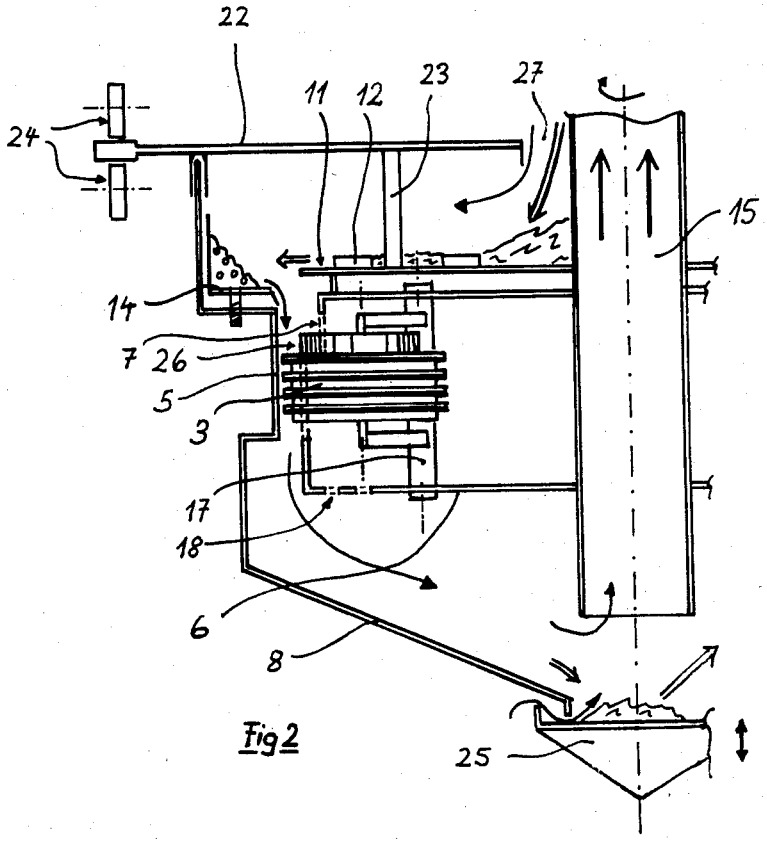
FIG. 2 is a sectional view of a part of another embodiment of the invention.

Describing now the drawings, reference is made initially to FIGS. 1 and 2. By means of FIG. 1 the basic principle of the invention will be explained first. At a central axle 1 suspension means 2 for hingedly carrying rollers 3 are provided. The rollers 3 driven by the axle 1 rotate along a milling path which extends in a horizontal plane and roll on the cylindric inner surface 5 of the milling chamber and are forced against it by means of the centrifugal forces. If necessary, the pressure can be increased by means of hydraulic or pneumatic cylinders. The suspension means 2 and the rollers 3 are covered by a housing 6 which also rotates and which forms a circular gap with the milling path 5, the function of which will be explained below. The rollers 3 laterally project through openings 7 in the housing 6. Under the milling path a collecting device is provided, from which the material can be fed back by means of a bucket conveyor (not shown). If several milling stages are disposed one upon the other (see FIG. 4), the material leaving the milling path instead enters the following stage.

Figure 6:
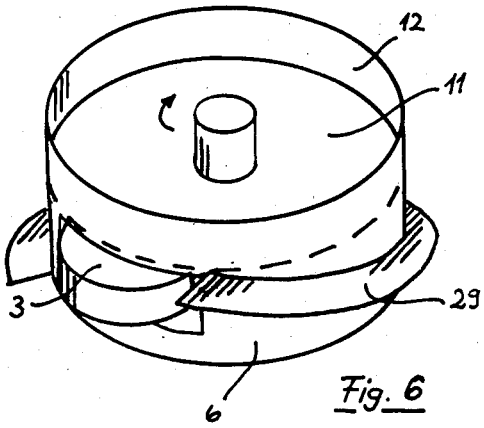
FIG. 6 is a perspective view of the roller housing of FIG. 4.

The material, which may be precrushed, is fed into the mill centrally onto a rotating distributor plate 11, which preferably is formed by the top wall of the housing 6. The material to be crushed then spreads over this plate simultaneously being moved outwards by centrifugal forces and radially leaves the plate. The distributor plate 11 may be provided with tangentially extending ribs or as shown in FIGS. 4 and 6 with a circumferential border 12, such that on the top of the distributor plate 11 a material layer is formed, over which the newly fed material rolls outwards. Thereby the wear of the distributor plate 11 can substantially be reduced. The material which is continuously fed to the distributor plate 11 therefore leaves the same evenly distributed and in radial direction. It then is collected on an annular collector ring 14 which can be adjusted in height and is disposed over the milling path. The main purpose of this collector ring is to catch the material thrown off the distributor plate and to discharge it with a well-defined and adjustable falling speed into the milling path. According to the embodiments of the FIGS. 1 and 2 the collector ring is formed by an annular shoulder 14 disposed above the milling path. The material deposited on this shoulder forms a defined angle of repose (FIG. 2), over which new pieces will roll down to finally fall into the milling path. The angle of repose is self-adjusting so that a stationary state will be created in which every piece will have defined falling conditions within a certain range. Another embodiment of the collector ring 14 will later be explained in connection with FIGS. 3 and 4.

The process of the invention now is such that each piece of the material to be crushed, when falling through the milling path, is subjected to the action of a milling roller 3 at least once. To this end the rotational speed f of the milling rollers 3 and the mean initial speed $V_o$ of the pieces entering the milling path have to be adapted to the number n of rollers 3 and their height h, which defines the height of the milling path. From the law of free fall:

$$h = \frac{g \cdot t^2}{2} + V_o \cdot t$$

and from the fact, that between two rollers transits at a given point of the periphery, there is a time gap of $$T = \frac{1}{n \cdot f}$$

condition for the initial speed $V_o$ of the pieces can be derived (when neglecting the influence of the air current):

$$V_o \leqq h \cdot n \cdot f - \frac{g}{2n \cdot f}$$

As a consequence thereof, an embodiment having four rollers 3 as shown in FIG. 1 is driven with half the rotating speed than an embodiment having only two rollers 3 (FIG. 4).

The milling process therefore is performed in a controlled way evenly around the whole circumference of the milling path. Each piece falling into the milling path is contacted by one of the rollers 3 and subjected to a pressure load between this roller and the wall of the milling path, by which load the pieces burst into several fractions. These fractions are removed from the milling path, simultaneously being separated according to their size by means of a directed air current across the milling path. The air current can either be directed upwards (FIG. 1), sidewards (FIG. 3) or downwards (FIGS. 2 and 4), wherein the last version has the advantage, that the direction of entrance of the pieces into the milling path is in parallel to the air current so that the falling height can be reduced and that the discharge of the fine fractions out of the milling path is performed more rapidly since the gravitational forces are in parallel to the air current. The bigger fractions fall off the milling path by their own weight and are collected in a trough 8 (FIG. 2), whereas the small sized pieces are carried away by the air current and are collected outside of the mill.

The pressure of the rollers 3 against the surface of the milling chamber forming the milling path results from the centrifugal forces of the rollers 3 which to this end are hingedly suspended, as can be seen from FIG. 1. If the center of the rollers rotates on a radius R at a rotational speed f and if the mass of the rollers is M, then the pressure force will be:

$$Z = Mf^2R \cdot 4\pi^2$$

If the rollers further have a radius r, a height h and are made of a metal having the specific gravity $\rho$, this force will be:

$$Z = 4\pi^3\rho \cdot h \cdot f^2 \cdot r^2 R$$

As to the values of h and f, the above condition for the initial speed $V_o$ has to be considered.

In a device as shown in FIG. 1, shock-absorbing elements can be placed between the hinging arms 4 and the suspension means 2 at the axis 1, in order to avoid radial vibrations and jumping of the rollers 3. Depending on the material to be crushed such elements may be cmitted when the material has a damping effect. If high pressure forces are used, hydraulic or pneumatic elements can be provided.

As already mentioned, the separation of the fine and the coarse material is made already in the milling path by means of the directed air current. The air current is generated by a fan which is disposed outside the mill. The air enters the milling chamber and is guided through a relatively small gap between the rotating housing 6 and the milling path 5, since the residual cross section is closed by the housing 6. Therefore, with relative small fan power a high air speed can be generated across the milling path. This effect may even be enhanced by means of inclined covering sheets 29 radially disposed at the housing 6 between the rollers 3 (FIG. 6), resulting in a further reduction of the material layer on the milling path, nevertheless allowing the entrance of bigger pieces into the milling path. The housing 6 which covers most of the rotating elements reduces turbulences in the air current, so that across the milling path a relatively well defined flowing direction is created. By means of controlling the fan power, the separating effect, i.e. the grain size of the pieces carried away, can be varied. The air current thereby does not influence much the pieces before being crushed.

After having explained the principle of the claimed process and device, it is referred now to FIG. 2 showing a first embodiment of the invention. Therein every roller 3 is suspended at a column 17, which is hingedly supported by the housing 6. The housing 6 is closed, but at its bottom wall is provided with openings 18 for releasing pieces which entered the housing through the openings of the rollers 3. The distribution plate 11 is disposed on the top of the housing and is provided with tangential ribs 12 as already explained. The annular shoulder 14 is adjustable in its vertical position to adjust the falling height and thereby the initial speed $V_o$ of the pieces when entering the milling path. Thereby, the rotational speed of the rollers and the initial speed of the material $V_o$ are adjusted in accordance with the above mentioned relation.

All rotating portions including the central tubular outlet 15 are driven by means of a disk 22 which is connected to the housing 6 over a torque transmitting structure 23. Stationary driving rolls 24 connected to an electric motor (not shown) are pressed against the disk 22 to provide a friction drive.

Through an opening 27 which is disposed near the tubular outlet 15 the material as well as the air enters the milling chamber. The air flow can be adjusted by lifting and lowering the collecting trough 25, thereby closing and opening an additional air inlet. The air carrying the fine particles leaves the milling chamber through the central tubular outlet 15 which is connected to a fan (not shown). Thereby, a slight under-pressure is generated within the milling chamber, such that no dust leaves the milling chamber. Below the housing 6 the airstream has a small tangential component provided by the rotating portions resulting in a cyclone separation effect in this area.

In contrast to the embodiment exhibited in FIG. 1 the air current in FIG. 2 is directed from the top to the bottom of the mill and is slightly accelerating the pieces falling from the annular shoulder 14 so that the vertical distance of the annular shoulder from the milling path can be reduced. The area below the housing 6 in combination with the tube 15 functions as an air separator for the material in the air current.

The rollers 3 can be provided with circumferential grooves. This is especially useful in combination with high rotational speed of the rollers, since the local air displacement in front of the rollers can be reduced. Furthermore, an upper portion 26 of the rollers 3 has a reduced diameter, which portion acts as a crusher for big pieces present in the material to be crushed.

The operation of the described embodiment also is continuous, i.e. the mill is continuously supplied with a stream of material to be crushed, which distributed over the circumference of the mill falls into the milling path. The rotational speed of the rollers and the falling speed of the material are adjusted such that each piece of the material is subjected to the action of a roller at least once. By controlling the airflow the grain size of the separated material can be chosen. The material which has not been crushed enough is fed back on the outside of the mill to the inlet 27. If, however, the throughput of the mill should be increased, several milling stages of the described type are combined (FIG. 4), so that part of the material leaving one stage is fed to a following stage, if the required grain size is not reached yet. Therefore, the size of the following stage can be reduced accordingly.

Figure 3:
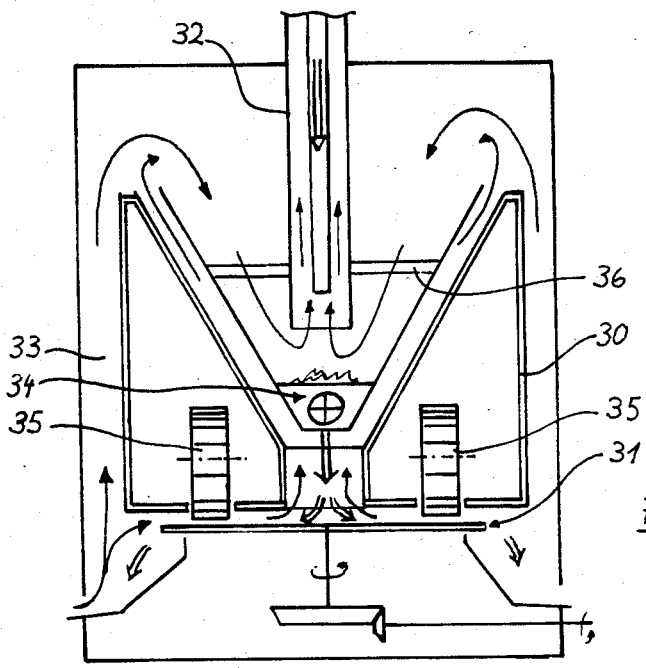
FIG. 3 is a schematic sectional view of an edge-runner mill comprising the features of the invention.
Figure 4:
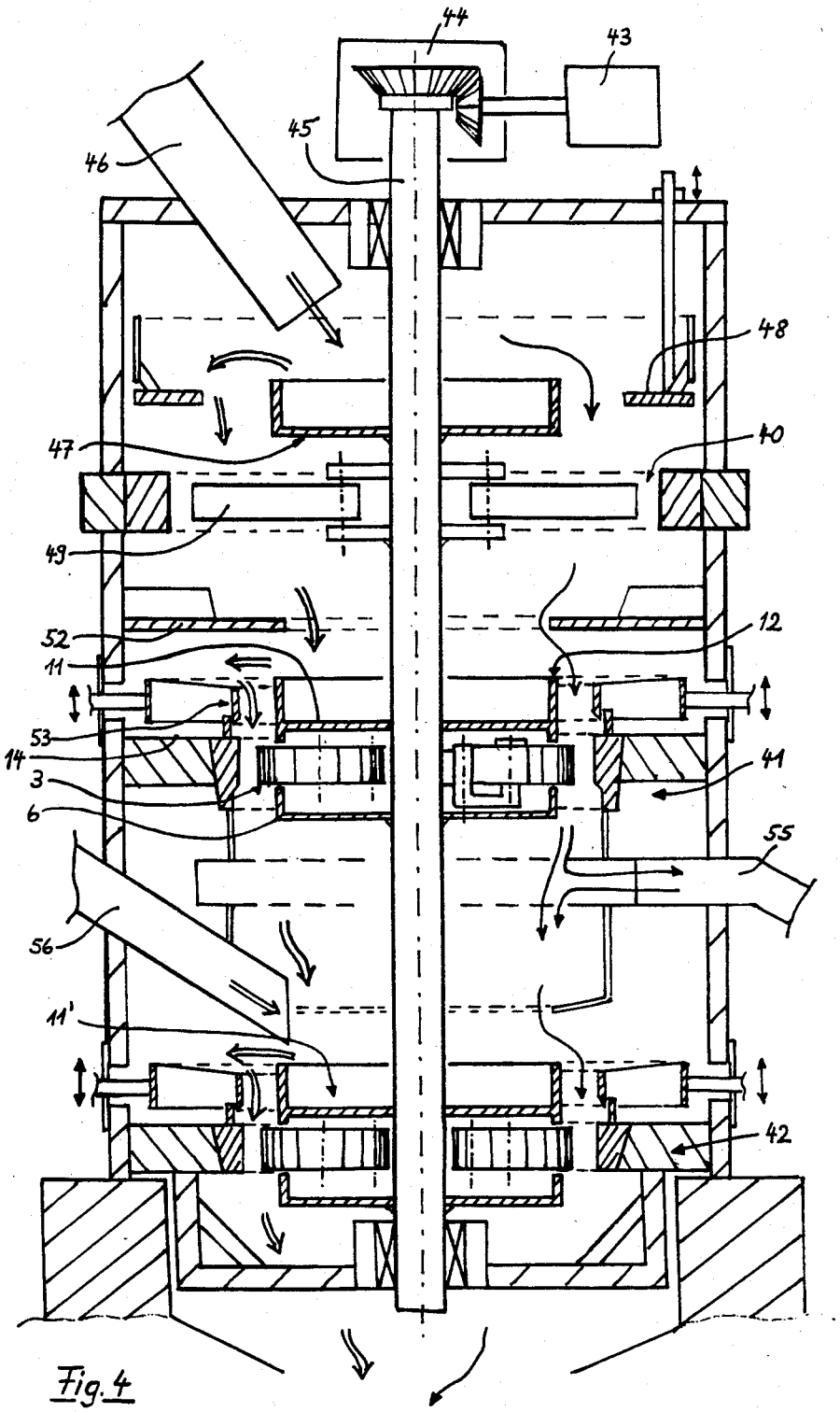
FIG. 4 is a multiple-stage roller mill of the invention in sectional view.

Before, however, describing the multiple stage-embodiment of the invention, reference is made to FIG. 3, showing an edge-runner mill of the invention. The edge-runners 35 are stationary mounted in a housing 30 and roll upon a rotating disc 31 which functions as a distributing device for the material and simultaneously as a milling path. Between the housing 30 and the milling path on said disc 3 an air gap is formed, through which an air current flows radially inwards to remove the crushed material, having a required maximum grain size, from the milling path. The air current containing part of the crushed material is guided to a tubular outlet 32 to which a fan is connected. At the side of the milling chamber 30 a channel 33 is provided, the cross section of which is adjustable for controlling the air current flowing across the milling path.

Centrally above the rotating disc 31 a material supplying device 34 is provided which prevents the air from passing, which may be accomplished by a winged cross. The material centrally supplied to the rotating disc 31 by said device 34 is distributed over the disc by the centrifugal forces. The material then enters the milling path with a radial velocity which depends from the rotational speed of the disc such that each piece is subjected to the action of an edge-runner 35 at least once. Pieces which have not been crushed enough are thrown outwards and fall over the periphery of the disc into a collecting device, from where they are fed back to the supplying device 34.

The space above the housing 30 together with the tubular outlet 32 form an air separator, wherein wings 36 cause a rotational flow of the falling air current.

The other effects of the device of FIG. 3 are the same as already mentioned above.

Figure 5:
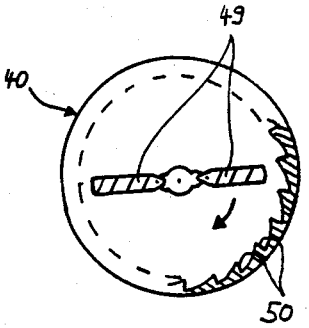
FIG. 5 is a schematic exhibition of a crusher used in the roller mill of FIG. 4.

In FIG. 4 a multiple-stage roller mill is shown, which operates according to the above explained principles of the devices of FIGS. 1 and 2. The multiple-stage mill comprises a precrusher 40 and two milling stages 41 and 42, which are suspended at a common axle 45. The axle 45 is driven at its upper end by an electric motor 43 which is connected to the axle over a gear 44. The material which enters the mill through an upper inlet 46 has a maximum grain size of about 15 cm and is supplied to a first distributor trough 47, as indicated by a double arrow. When the trough 47 is partly filled, the additional material is thrown to the outside by the action of centrifugal forces and caught by the annular shoulder 48. On this shoulder a stationary material layer is formed having a slope of a certain angle over which the additional material fed falls down evenly distributed over the circumference of the mill and enters the path of the precrusher 40, which in FIG. 5 is shown partly in cross section. The precrusher 40 has two hingedly suspended impact crusher wings 49 and an outer ring having breaker teeth 50, against which the fractions of the pieces are thrown under the action of the crusher wings 49, thereby being further crushed. The vertical distance of the shoulder 48 from the precrusher 40 is adjusted to the height of the precrusher and its rotational speed such that each piece is subjected to the action of one of the wings 49, as already explained in connection with the milling process. The material leaving the precrusher has a maximum size of about 1 cm. It is guided by a ring 52, on which a sloped stationary layer is formed, into a second distributor trough 11 which belongs to the first milling stage 41 and from there onto an annular shoulder 14 of the first stage. An annular wall 53 which is adjustable in height allows the control of the falling height of the material into the milling path. Behind this wall 53 a sloped material layer of adjustable thickness is formed, over which the pieces fall into the milling path, where they are subjected to the action of one of the two rollers 3. The rollers 3 are arranged within a housing 6, as shown in FIG. 6. Between the rollers cover sheets 29 are mounted to the housing, by which the air current is concentrated to the milling path. The cover sheets 29 are inclined to allow the entrance of bigger pieces into the milling path. The milling process occurs under the influence of an air current which schematically is indicated by single arrows in the right half of FIG. 4. Below the first milling stage 41 an air control device 55 is provided for adjusting the air current through the mill and which is connected to a fan (not shown). The fan is also connected with the outlet at the bottom of the mill such that the air current flows from the top to the bottom of the mill. The air is sucked in through the inlet 46 and first traverses the first milling stage 41. Between the first and the second stage, part of the air current can be drawn off or air can be added by means of the air control device 55. In the first mentioned case the air current in the first stage and in the second case the air current in the second stage is increased. Providing that there is a constant pressure drop over the mill, the parts of this pressure over the individual stages can be adjusted accordingly.

Above the second stage 41 of the mill there is a second inlet 56 for material coming from an air separator (not shown). The material, which has not yet reached the required grain size, is fed back to the second milling stage 43 together with the material from the first stage. The air current through the second milling stage is adapted to the finer grain of the pieces passing through that stage.

The operation of the mill is continuous in that the amount of material fed through inlet 46 is adjusted to the milling rate of the milling stages considering the portions fed back to the second inlet 56.

The milling process described and the mills for carrying out the same have a lower energy consumption than known devices, because the crushed material immediiately is removed from the milling path. The controlled flow of material and air through the mill results in an effective crushing process since at each given moment only a few parts of the material is present in the milling path so that the power of the rollers is not consumed by compressing and pushing forward a thick layer on the milling path but is concentrated to the crushing action. The guided air current allows the use of a fan having reduced power consumption.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. In a roller mill having at least one milling stage, said milling stage comprising a circular milling path, a plurality of rollers supported to roll along and upon said circular milling path, a feeding device for feeding the material to be crushed into said mill, a distribution device for evenly distributing said material along the circumference of said milling path and for continuously introducing it into the milling path substantially in a direction parallel to the axis of the rollers and an air current generation means, the improvement comprising air guiding wall means facing said milling path and extending parallel thereto to form an air gap in between for guiding said air current transversely over said milling path, said wall means comprising openings through which said rollers project into said gap and said milling path being arranged to release said material after its having been subjected to the action of a roller.

2. The roller mill of claim 1 further comprising a central rotatably driven axis, wherein said milling path forms a cylindric surface concentric to said axis, said rollers being hingedly suspended at and driven by said axis to roll along said cylindric surface thereby being pressed against said surface by centrifugal forces and said distribution device being arranged above said cylindric surface to cooperate with a concentric shoulder, from which said material under the action of gravity falls into said milling path, and wherein said air gap is open at its bottom side such as to release the crushed material downwardly from the milling path.

3. The roller mill of claim 2, wherein the distribution device comprises a horizontal distribution plate mounted to said central axis having means for retaining part of the material to form a material layer on the plate, upon which the supplied material is distributed and moves radially outwards due to centrifugal forces such as to be collected on said concentric shoulder.

4. The roller mill of the claim 3, wherein said housing has an upper wall, said upper wall forming the bottom of said distribution plate.

5. The roller mill of claim 2, further comprising a housing for said rollers being mounted to said axis to rotate therewith and having a cylindric outer wall which is concentric to said milling path to form said air gap and is provided with openings for said rollers.

6. The roller mill of claim 5, wherein the rollers have an upper section of reduced diameter for precrushing bigger pieces.

7. The roller mill of claim 5, wherein the rollers are provided with a cylindric surface having circumferential grooves formed therein for reducing the air displacement in front of each roller.

8. A multiple stage roller mill having a plurality of milling stages and a feeding device for feeding the material to be crushed at least into a first of said milling stages, each milling stage comprising a circular milling path, a plurality of rollers supported to roll along said circular milling path, a distribution device for evenly distributing said material to be crushed coming from the feeding device or from a preceding milling stage along the circumference of said milling path and for introducing it into the milling path of said milling stage in a direction transverse to its circular extension, said roller mill further comprising an air generation means for generating an air current across the milling paths of all milling stages, said milling stages having air guiding wall means facing the respective milling path and extending parallel thereto to form an air gap in between for guiding said air current transversely over said milling path, each milling path further being arranged to release the material after its having been subjected to the action of the respective rollers to the distribution device of the next milling stage or to an outlet.

9. The multiple stage roller mill of claim 8, further comprising a central rotatably driven common axis, wherein each of the milling paths forms a cylindric surface concentric to said axis, and wherein the rollers of all milling stages being hingedly suspended at and driven by said common axis to roll along their respective milling paths thereby being pressed against the respective cylindric surfaces by centrifugal forces.

10. The multiple stage roller mill of claim 9, further comprising a precrusher being arranged above the first of said milling stages and having two crusher wings hingedly supported and rotatably driven by said common axis, a distribution device for evenly distributing the material from said feeding device over the path of said wings and for introducing said material into said path, an outer breaker ring concentrically to said axis and in a plane with the path of said wings to receive the material ejected radially by the action of said wings.

* * * * *